US005415499A

United States Patent [19]

Hyde-Smith et al.

[11] Patent Number: 5,415,499

[45] Date of Patent: May 16, 1995

[54] METHOD FOR THE REPAIR OF EXISTING MANHOLES USING ELASTOMERIC MATERIALS

[75] Inventors: Peter K. Hyde-Smith, Mayville; Yeara Houvras, West Bloomfield, both of Mich.

[73] Assignee: Foamseal, Inc., Oxford, Mich.

[21] Appl. No.: 138,786

[22] Filed: Oct. 19, 1993

Related U.S. Application Data

[63] Continuation-in-part of Ser. No. 878,943, May 5, 1992, Pat. No. 5,405,218.

[51] Int. Cl.[6] ..... E02D 29/12

[52] U.S. Cl. ..... 405/303; 405/36; 405/258; 523/214; 427/373; 521/99; 521/114

[58] Field of Search ..... 405/258, 303, 36–48; 156/294, 287; 521/78, 99, 114; 523/214; 427/373

[56] References Cited

U.S. PATENT DOCUMENTS

| | | | |
|---|---|---|---|
| 3,258,477 | 6/1966 | Plueddemann | 556/421 |
| 3,440,086 | 4/1969 | Kerns | 427/373 |
| 3,671,562 | 6/1972 | Pepe et al. | 556/421 |
| 3,905,945 | 9/1975 | Iseda et al. | 528/51 |
| 4,652,497 | 3/1987 | Ascarelli et al. | 428/447 |
| 5,002,438 | 3/1991 | Strong | 405/303 |
| 5,006,573 | 4/1991 | Plueddemann | 523/214 |

*Primary Examiner*—Dennis L. Taylor

*Attorney, Agent, or Firm*—Howard & Howard

[57] ABSTRACT

This invention relates to a method of repairing existing manholes and similar structures by applying a fast-curing elastomeric material using spray techniques whereby a homogeneous, non-porous, and monolithic coating or lining is formed. The fast-curing elastomeric material can be applied directly to existing substrates, which may comprise of concrete, brick, tile, mortar, and metal surfaces normally found in sewer manholes and catch basins, sewer and drainage pipes, parking decks, bridge piers and footings, holding ponds, bridge trusses, culverts, gratings, and the like and does not require any formwork. More preferably, the substrate surfaces are first cleaned and primed to improve the bond of elastomeric coating to the substrate. The most preferred primer is an aqueous solution of silane, preferably containing 10% to 30% silane. The elastomeric coatings provide effective surface protection against water infiltration, wear, and corrosion and can be applied in a single operation to horizontal, vertical, and overhead surfaces. The elastomeric materials are prepared by initiating the reaction of an isocyanate-terminated compound or polymer with an amine-terminated polymer or an aliphatic or aromatic diamine immediately before applying the elastomeric material to the surface to be coated. Preferably the reactive component (i.e., isocyante-containing and amine-containing materials) are mixed directly in the spray gun used to apply the elastomeric material.

9 Claims, 1 Drawing Sheet

METHOD FOR THE REPAIR OF EXISTING MANHOLES USING ELASTOMERIC MATERIALS

RELATED APPLICATION

This application is a continuation-in-part application of U.S. patent application, Ser. No. 07/878,943, filed May 5, 1992, now U.S. Pat. No. 5,405,218.

BACKGROUND OF THE INVENTION

This invention relates generally to a method of repairing existing manholes and similar structures using elastomeric materials. More specifically, this invention relates to a method of repairing existing manholes and similar structures by applying a fast-curing elastomeric material using spray techniques whereby a homogeneous, non-porous, and monolithic coating or lining is formed. In the most preferred embodiment, the surfaces to be coated are first cleaned and primed with a water-based primer. The fast-curing elastomeric material can be applied directly to existing concrete, brick, tile, mortar, and metal surfaces normally found in sewer manholes and catch basins, sewer and drainage pipes, parking decks, bride piers and footings, holding ponds, bride trusses, culverts, ravines, and the like and does not require any formwork. The elastomeric coatings of this invention provide effective surface protection against water infiltration, corrosion, and wear and can be applied in a single operation to horizontal, vertical, and overhead surfaces. The elastomeric materials used in the present invention are prepared by initiating the reaction of a isocyanate-terminated compound or polymer with an amine-terminated polymer or an aliphatic or aromatic diamine immediately before applying the elastomeric material to the surface to be coated. Preferably the reactive components (i.e., isocyanate-containing and amine-containing materials) are mixed directly in the spray gun used to apply the elastomeric material.

The repair and rehabilitation of the infrastructure in most of the industrialized world has become of increasing importance in recent years. The deteriorating infrastructure—including engineering structures such as sewer systems, water collection systems, brides, culverts, catch basins, and the like—is becoming an ever increasing challenge to repair and maintain in a cost effective and timely manner. Of particular importance are the sewer systems—including both the lines and access manholes—in our older cities which may have been installed a century or more ago. Due to the location of many of these systems below ground, deterioration of the infrastructure is generally not readily apparent to the public until there is acute failure resulting in cracked pavement, collapsed streets, sewer backups, local flooding, low water pressure, or other severe problems. Also due to the underground location of these structures, complete replacement of the systems is very expensive as well as disruptive of human and economic activities above ground. If a sewer system is allowed to deteriorate until acute failures occurs, often the only method available to correct the problem is total replacement of the failed portion of the system. It is preferred, therefore, to apply preventive maintenance measures to such systems to prevent, or at least minimize, such acute failures and to maintain the operating capabilities of such systems. It is desirable, therefore, to provide methods by which such engineered structures can be repaired simply, effectively, with minimal downtime, and at a low-cost.

Several methods short of total replacement have been developed for the repair or rehabilitation of existing structures such as sewer manholes. For example, U.S. Pat. No. 5,002,438 provides for the repair of existing manhole structures by the spray application of a cementitious mixture to the interior of the manhole structure to form a liner. Two to five hundred pounds of the cementitious mixture is generally required to repair a typical manhole structure. And such a liner can only be put back into service after the cement mixture sets. A booklet published by the U.S. Department of Housing and Urban Development entitled "Utility Infrastructure Rehabilitation" (November 1984) ("Booklet") also presents several methods that are reportably useful in such rehabilitation efforts. These methods include (1) coatings (such as epoxy, acrylic, or polyurethane) applied to the interior walls of the manhole, (2) chemical grouts injected into the surrounding ground from the interior of the manhole, and (3) structural liners (e.g., a fiberglass liner) inserted inside the manhole. Booklet at 5-57 to 5-58. None of these methods have proven to be completely satisfactory. For example, although it is known to apply polyurethane coatings with a airless sprayer, the surface to be coated by be very clean, free of debris, structurally sound, . . . [and] dry." Id. at 5-57. For structurally damaged or disintegrated manhole structures (i.e., the structures most in need of repair and most likely to be found in the sewer systems of our older cities), only the structural liners are reported to be useful. Id. at 5-59. Thus, additional methods are needed to repair and rehabilitate existing manholes, especially structurally damaged or disintegrated manhole structures. It would be desirable to provide a relatively simple and quick method for the repair or rehabilitation of both structurally sound manholes and structurally damaged or disintegrated manholes. It would also be desirable if such a method used a minimum of materials and if the repaired manhole could be returned to service almost immediately. It would also be desirable if such a method could be used on both the brick and mortar interior surfaces as well as on metal surfaces commonly found in manholes. The present invention provides such a method. Other advantages and benefits of the present invention will become apparent upon a review of the specification.

SUMMARY OF THE INVENTION

The present invention relates to a method of repairing existing manholes and similar structures by applying a fast-curing elastomeric material using spray techniques whereby a homogeneous, non-porous, and monolithic coating or lining is formed. Following and preferably priming the surfaces, the fast-curing elastomeric material can be applied directly to existing concrete, brick, tile, mortar, and metal surfaces normally found in sewer manholes and catch basins, sewer and drainage pipes, parking decks, bride piers and footings, holding ponds, bridge trusses, culverts, gratings, and the like. The elastomeric coatings of this invention provide effective surface protection against water infiltration, corrosion, and wear and can be applied in a single operation to horizontal, vertical, and overhead surfaces. The elastomeric materials used in the present invention are prepared by initiating the reaction of a isocyanate-terminated compound or polymer with an amine-terminated compound or polymer or an aliphatic or aromatic diamine immediately before applying the elastomeric material to the surface to be coated. Preferably the reactive components (i.e., isocyanate-containing and amine-containing materials) are mixed directly in the spray gun used to apply the elastomeric material. By varying the two reactive components, the properties of the elastomeric material can be varied and adjusted for the intended application.

The present invention provides an easy, relatively inexpensive, and effective method to line or reline engineering structures constructed of brick, tile, concrete block, concrete, mortar, metal, and like materials of construction. Because the elastomeric material is applied with spray techniques and is fast curing, formwork is not required and the materials can be applied to horizontal, vertical, and overhead surfaces with minimal dripping or wasted material. Due to the ease of application, the thickness of the applied elastomeric coating or lining can be widely varied depending on the intended application. Thinner coatings (i.e., about 0.05 to 0.25 inches) can be used where only a sealing coating is required. Thicker coatings (i.e., 0.25 to 0.75 inches) may be used for increased structural reinforcement as well as sealing. Even thicker coatings may be used in local areas for patching (e.g., plugging holes left by missing bricks) before the general monolithic coating is applied. Using the elastomeric material as such a patching material can significantly reduce the time necessary for repairing a badly damaged or deteriorated manhole.

One object of the present invention is to provide a method for lining or relining an existing engineering structure to rehabilitate, reinforce, and protect the engineering structure, the method comprising:

(1) Preparing the surface of the engineering structure to be lined or relined by cleaning the brick, tile, concrete lock, concrete, mortar, or metal forming the surface and removing loose particles of brick, tile, concrete block, concrete, mortar, or foreign material from the surface;

(2) Applying a primer, most preferably a silane primer, to the surfaces to be coated to enhance the adhesive bond of the elastomeric material to the substrate. The most preferred primer is an aqueous silane solution. The primer is applied by standard low pressure spray techniques and allowed to dry;

(3) Applying a fast-curing elastomeric material to the prepared surface of the engineering structure to be lined or relined by spraying the fast-curing elastomeric material onto the prepared surface, whereby a monolithic, continuous elastomeric coating is formed on the prepared surface, wherein the fast-curing elastomeric material is prepared by rapidly mixing and initiating the reaction of an isocyanate-terminated compound-containing mixture and a second component, most preferably an amine-terminated compound-containing mixture, immediately before spraying the fast-curing elastomeric material onto the prepared surface; and (4) Allowing the fast-curing elastomeric coating to cure, whereby an elastomeric liner is formed on the prepared surface to rehabilitate, reinforce, and protect the engineering structure.

The elastomeric material is preferably formulated to cure such that the mixed components remain liquid long enough to wet out and penetrate the surface in order to increase the mechanical bond to the engineered structure. A lower exotherm is generated, such that thermal cracking and shrinkage is minimized. The elastomeric material should also be formulated to be elastic enough to withstand frame and wall movement due to ground heaves, without cracking, tearing or breaking. Finally, the elastomeric material is preferably light in color, enabling effective use of titanium dioxide pigment to enhance inspection capabilities.

Another object of the present invention is to provide a lined manhole forming a portion of a sanitary or non-sanitary sewer system and buried below ground level, such lined manhole comprising:

(1) A housing with an interior surface formed of brick, tile, concrete block, concrete, or mortar having an interior space to allow human access to a buried conduit forming a portion of the sanitary or non-sanitary sewer system wherein the housing is adapted to be buried in the ground; and (2) A sprayed elastomeric liner within the interior of the housing forming an essentially continuous, non-porous, monolithic liner formed in place, bonded to the interior surfaces and substantially conforming to the geometry of the interior of the housing, wherein the sprayed elastomer liner is formed from a fast-curing elastomeric material sprayed onto the interior surface of the housing and wherein the fast-curing elastomeric material is the reaction product of an isocyanate-terminated compound and an amine-terminated compound.

These and other objects and advantages of the present invention will become apparent upon a consideration of the following figures and description of the preferred embodiments.

DETAILED DESCRIPTION OF THE PREFERRED EMBODIMENTS

This invention relates to a fast-curing elastomeric material which can be sprayed onto surfaces normally found in engineering structures to form a homogeneous, monolithic, and non-porous liner. Engineering structures which can be treated by the method of this invention include existing sewer manholes and catch basins, sewer and drainage pipes, parking decks, bridge piers and footings, holding ponds, bridge trusses, culverts, gratings, and the like which have surfaces of concrete, brick, tile, mortar, metal, and the like. Manholes normally found in sanitary and non-sanitary sewer systems are especially preferred structures for lining or relining by the method of this invention.

Figure 1:
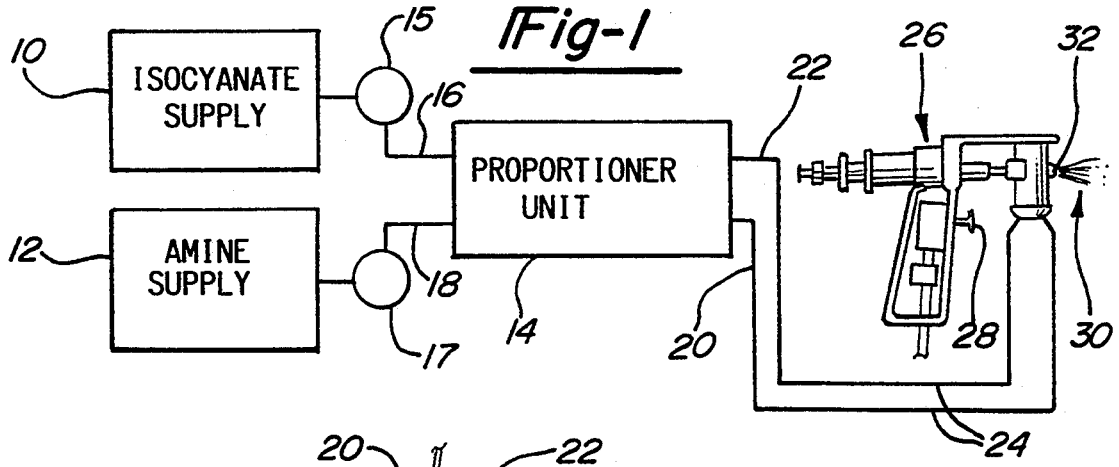
FIG. 1 provides a schematic representation of an apparatus suitable for applying the elastomeric materials of the present invention.

The elastomeric material of the present invention is prepared by reacting an isocyanate-terminated compound or polymer containing at least two reactive isocyanate groups with an amine compound or polymer containing at least two reactive amine groups. The two reactive components are mixed immediately before being spray applied to the surface to be coated. FIG. 1 is a schematic representation of an apparatus suitable for applying the elastomeric coating of the present invention. A source of the isocyanate-terminated compound 10 and a source of the amine-containing compound 12 are separately connected to a control unit 14 by lines 16 and 18, respectively. Pumps 15 and 17 are located in lines 16 and 18, respectively, to transfer the liquid reactants to the control unit 14. The control unit 14 allows precise and accurate control of the relative amounts, temperatures, and pressures of two reactants fed to the spray gun 6. The isocyanate-terminated compound from source 10 is fed through line 16 by pump 15 into control unit 14 and then through line 22 to spray gun 26. The amine-containing compound is similarly fed from source 12 through line 18 by pump 17 into control unit 14 and then through line 20 to spray gun 26. Preferably, lines 20 and 22 are physically connected or bundled (i.e., bundled line 24) at some point after exiting from the control unit 14 to minimize tangling of the separate lines. The bundled line 24 is connected directly to the spray gun 26 which is equipped with a trigger 28 to activate the spraying action and a nozzle 32. The sprayed fast-curing elastomeric material 30 is applied directly to the surface to be coated.

Because of the very reactive components used and the fast-curing nature of the elastomeric material formed from the reactive components, the reactive components are preferably mixed directly in the spray gun 26. Suitable spray guns are commercially available. One especially preferred spray gun is a Model GX7 spray gun from Gusmer of Lakewood, N.J. The control unit 14 is also commercially available. Especially preferred control units include the H-2000 proportioner unit from Gusmer and the FS2000 proportioner unit from Foamseal of Oxford, Mich. These units can typically supply and deliver about 10 to 30 pounds of material per minute at a pressure of about 1000 to 3500 psi. Generally, an output rate of about 15 to 25 pounds/minute at about 1200 to 2500 psi is preferred. Both of these proportioners include pumps and temperature and pressure controls for accurate metering and control of the raw materials to the spray gun. Pumps 15 and 17 used to transfer reactants to the control unit 14 are also commercially available. Preferred pumps 15 and 17 include air-driven 2:1 transfer pumps from Gusmer. Preferably, reactant supplies, transfer pumps, and the control unit are located on a mobile trailer or truck bed (not shown) to allow easy movement to the manhole or other engineering structure to be lined.

Figure 2:
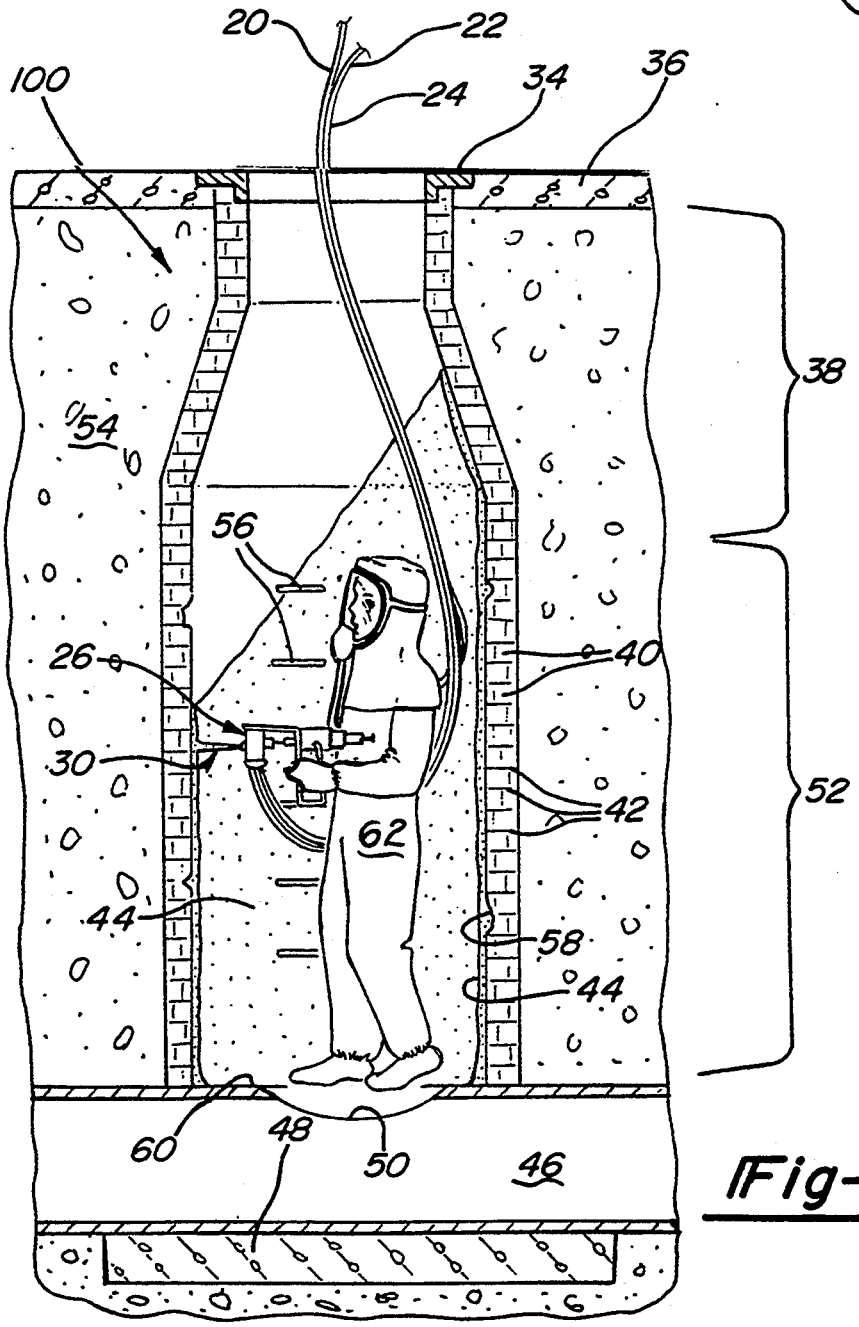
FIG. 2 illustrates the application of the elastomeric materials of the present invention in a typical manhole structure.

FIG. 2 shows a manhole 100 being lined by the method of the present invention. Manhole 100 has a frame 34 (usually metal) for receiving the manhole cover (not shown) and allowing access to the interior of the manhole. The frame 34 is level with the ground or roadbed 36. The upper portion 38 (often referred to as the chimney) and the lower, vertical portion 52 (generally of uniform diameter) are generally constructed of bricks 40 and mortar joints 42 bonding the bricks together. The manhole 100 is buried below the ground or roadbed surface 36, is buried within and contacts the ground 54, and generally rests upon a concrete base 48. The bottom 60 of the manhole is intersected with an opening 50 in the sewer conduit 46 through which water flows. The manhole 100 has metal ladder rungs 56 which allow easy entry and exit for the workperson 62. As shown in FIG. 2, the workperson 62 is applying elastomeric material 44 to the interior surfaces of the lower portion 52 from the spray gun 26. The spray gun 26 is connected via bundled transfer line 24 (containing separate isocyanate supply line 22 and amine supply line 20) to the control unit 14 (not shown) on the surface. The isocyanate reactant and the amine reactant are mixed in the spray on 26 and then sprayed 30 upon the interior surfaces, including the metal step rungs 56, to form a homogenous, monolithic, non-porous liner that conforms to the configuration of the interior portion and covers the brickwork 40 and the mortar 42. The elastomer material can also be used to patch large voids 58 in the brickwork (e.g., where a portion or an entire brick is missing). In FIG. 2, the lower portion 52 and the bottom 60 have been lined with elastomeric material 44. To complete the job, the workperson 62 will simply continue spraying the elastomer material 30 onto the upper surfaces 38 and at least a portion of the metal frame 34 until the interior surfaces of the manhole are coated to the desired thickness.

One advantage of the present method is that the elastomeric material can be applied to horizontal, vertical, and overhead surfaces without significant dripping or sagging. Thus, the workperson 62 in FIG. 2 can easily coat the upper, overhead portions 38 of the manhole while standing on the bottom 60 or, if desired, elevated on the ladder rungs 56. Of course, the workperson 62 could, if desired, complete the coating of the upper portion 38 from ground level. Another advantage of the present method is that the equipment used to apply the elastomeric material (i.e., spray gun 26 alone with bundled supply lines 24) are very lightweight and easily maneuverable and can, therefore, be used to coat overhead surfaces with minimal worker fatigue. Still another advantage of the present invention is the rapid curing of the elastomeric material. Not only can the manhole or other engineering structure be put back into operation quickly, but the operator can walk on the cured material within a matter of minutes. Thus, the workperson 62 in FIG. 2 could spray a portion of the bottom 60 and the adjacent vertical surfaces of the manhole and then after only a few minutes stand on the portion of the bottom already coated to finish the application on the remainder of the bottom and interior surfaces. Likewise, ladder runs 56 can be sprayed and then used to exit the manhole after by a few minutes. Another advantage of the present invention is the speed in which a manhole can be rehabilitated. A typical manhole (e.g., ten feet deep and four feet in diameter) can normally be sprayed, and therefore rehabilitated and lined, with the elastomeric material of this invention in thirty minutes or less and put back into service immediately. Of course, badly deteriorated structures where significant patching or other repair work is necessary will be expected to take longer. Still another advantage of the present invention is that because metal surfaces can be coated by the elastomeric materials of this invention, it is not necessary to remove ladders or other metal structures prior to applying the coating material. In addition, by coating both the brick, mortar, and metal surfaces, a monolithic surface is formed on those surfaces and the interfaces and joints between the dissimilar substrate surfaces thereby providing even more protection. And because of the elastomeric nature of the coating, the liner is essentially unaffected by thermal cycling of the structure (especially at the interfaces of the dissimilar substrates) caused by variation of the ambient temperature.

Before the elastomeric material of the present invention is applied, it is generally desirable to prepare the surface to be repaired. The extent of the preparation will, of course, depend largely upon the condition of the surfaces and the presence, if any, of contaminants on the surface or within the interior of the manhole. Cleaning and preparation can be carried out by conventional means, such as water or steam spraying and cleaning including the use, if appropriate, of detergents or surfactants. Such preparation should remove loose materials such as broken bricks, loose mortar, and loose paint or rust on any metal surfaces. Structural repairs or modifications, if needed, should be performed prior to application of the elastomer material. Voids (e.g., missing bricks or mortar) can be filled with mortar or concrete patching material or, if desired, with the same elastomeric material used to form the elastomeric liner or coating.

After cleaning and repair of the surfaces to be coated, it has been found desirable in most applications for the surfaces to be primed to improve adhesion of the elastomeric material to such surfaces. Several primers have been tried under laboratory conditions, including for example polyisocyanate prepolymers applied neat or in solution in propylene glycol monoethylether acetate/Xylene (e.g., "DESMODUR" E-21[11] and "MONDUR" CB-60 available from Miles, Inc.), a dispersion of ethylene acrylic acid (e.g., "MICHEMPRIME" 4983 and 9234, available from Michelman) and aminoethyl aminopropyl trimethoxy silane ("Z-6020" available from Dow Corning). The adhesion of the elastomeric material without a primer was then compared with the various primers. The polyisocyanate prepolymers showed some promise, particularly the Primer #733 from ChemRex, Inc., which is an isocyanate and solvent solution. However, solvent-based polymers were rejected because of the application and potential pollution. The EAA primers (ethylene acrylic acid) also showed some improvement and are water soluble. However, the most significant improvement in adhesion was found using an aqueous solution of silane. Surprisingly, however, a 20% solution of silane in water resulted in an over 200% improvement in adhesion, compared to a very small improvement (5%) using a 5% water solution of silane (as recommended by the manufacturer), a 45% improvement using silane neat and a 51% improvement using a 10% solution of silane in water. A test of a 40% solution of silane in water failed to provide any improvement in adhesion. Thus, the preferred method of this invention includes applying an aqueous solution of a silane primer to the surfaces to be coated prior to application of the elastomeric coating.

Although the elastomeric materials of this invention can be applied year round, better results are generally obtained at ambient temperatures of about 0° to 150° F. Largely for convenience, ambient temperatures of 65° or higher are preferred. Generally, substrate temperatures of about 40° to 200° F. are acceptable. Typically, substrate temperature are normally in the range of about 55° to 75° F. depending on the season. The temperature of the isocyanate-containing and amine-containing reactants are generally in the range of about 100° to about 200° F. and are preferably in the range of about 130° to 180° F. and are more preferably in the range of about 150° to 160° F. At lower ambient or substrate temperatures, it may be preferred to employ the reactants at a temperature at the higher end of the range. Although it is generally preferred that the two reactants be at roughly the same temperature when mixed and reacted, it is not necessary. And although it is generally preferred that the relative amounts of the two reactants are essentially 1 to 1 (by either volume or weight, depending on whether the actual control units use volume or weight control parameters), it is not necessary. The relative ratio of 1 to 1 for the reactants allows for easier adjustment and control of the process. However, other relative ratios can be used so long as the resultant elastomeric material has the necessary properties.

The elastomeric material of the present invention is prepared by mixing and reacting an isocyanate-terminated compound or polymer with an amine-terminated polymer or an aliphatic or aromatic diamine compound and then essentially immediately applying the resultant reacting mixture to the surface to be coated and repaired. Preferably the mixing of the two reactants is effected directly within the spray gun used to apply the mixture (i.e., impingement mixing).

Suitable isocyanate-terminated compounds or polymers must have at least two terminal isocyanate groups and may be either aliphatic or aromatic in nature. The isocyanate-terminated compounds suitable for use in this invention have mean functionality of about 2 to 3.2 and contain about 15 to 35 weight percent isocyanate groups. Preferred isocyanate-terminated compounds are based on, or derived from, methylene diphenyl diisocyanate (MDI). Preferred isocyanate-terminated compounds are of the monomers or polymers of the general formula I

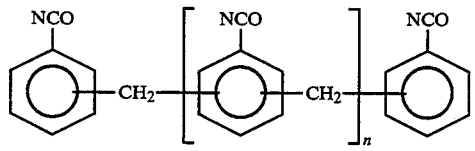

where n is an integer from 0 to about 10 and preferably from 0 to about 4. The isocyanate-terminated compound I is methylene diphenyl diisocyanate when n is zero and is a polymeric methylene diphenyl diisocyanate when n is greater than zero. Mixtures of the compounds I can also be used. In fact, a mixture containing compound I where n equals 0, is one preferred isocyanate-terminated compound. Preferably compound I is, when n equals 0 a mixture of the 4,4'-methylenediphenyl diisocyanate and the 2,4'-methylene diphenyl diisocyanate isomers. Often, this mixture will contain a small amount of the 2,2'-isomer (i.e., 2,2'-methylene diphenyl diisocyanate). Compound I with n greater than or equal to 1 is a linear polymer. As those skilled in the art will realize, branched polymers can also be used where methylene phenyl isocyanate group are attached directly to one or both of the phenyl rings in the methylene diphenyl diisocyanate structure. Mixtures of such linear and branched polymers can also be used. Other preferred isocyanate-terminated compounds are quasi-prepolymers of the general formulas II and III:

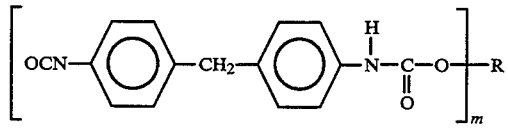

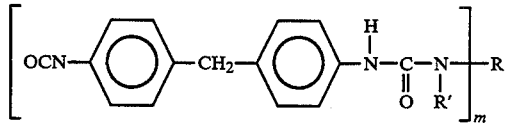

where m is equal to 2 or 3, R' is a hydrogen or an aliphatic radical (e.g., methyl or ethyl radical), and R represents an aliphatic polyether. The polymer II is an isocyanate-terminated quasi-prepolymer prepared by reacting a polymer as defined in formula I with a dihydroxyl-terminated or a trihydroxyl-terminated polyol. The polymer III is an isocyanate-terminated quasi-prepolymer prepared by reacting a polymer as defined in formula I with a diamine-terminated or a triamine-terminated polyether. Generally, quasi-prepolymers of general formula II are preferred. Especially preferred polyols are the aliphatic polyether polyols. For example, reacting a hydroxyl-terminated polyether (HO~OH) with methylene diphenyl diisocyanate yields a isocyanate-terminated prepolymer as illustrated in the following equation:

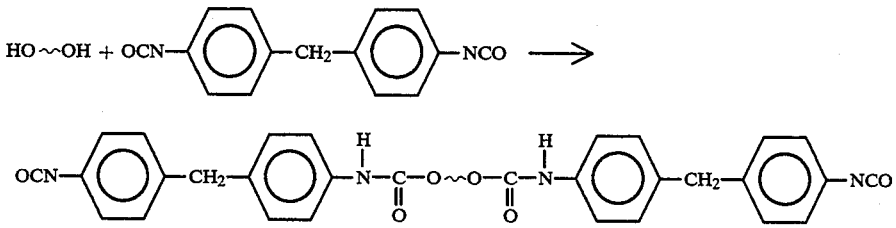

where ~~ represents the aliphatic polyether portion. Similarly, a polyether diamine could be reacted with methylene diphenyl diisocyanate. Examples of such aliphatic polyether groups include the following:

$$-CH_2\underset{\underset{R''}{|}}{CH}\left[OCH_2\underset{\underset{R''}{|}}{CH}\right]_x OCH_2\underset{\underset{R''}{|}}{CH}-,$$

$$-CH_2CH_2CH_2\left[OCH_2CH_2CH_2\right]_x OCH_2CH_2CH_2-, \text{ and}$$

$$-CH_2CH_2CH_2CH_2\left[OCH_2CH_2CH_2CH_2\right]_y OCH_2CH_2CH_2CH_2-$$

the like, where each R'' is independently a hydrogen or a methyl radical. Thus, these polyether compounds are based on the polymerization of ethylene oxides, propylene oxides, butylene oxides, and the like. Preferably, x has an average value such that the molecular weight of the polyol portion is in the range of about 500 to 6000, and more preferably in the range of about 500 to 2500.

The quasi-prepolymers are prepared by reacting an excess of methylene diphenyl diiocyanate with a polyether polyol (terminated with either two or three hydroxyl groups) or the polyether amine (terminated with either two or three reactive amine groups, preferably primary amine groups) to obtain a liquid quasi-prepolymer. Generally an equivalent ratio for the reactants (as expressed in terms of —NCO to —OH or —NCO to —NH) of about 2 to 1 or greater, respectively, is acceptable although the equivalent ratio of the reactants and the reaction conditions can be varied so long as the resultant quasi-prepolymer remains liquid at, or slightly above, room temperature. The quasi-prepolymers must contain sufficient free isocyanate groups to react with amine-terminated compounds when the actual elastomeric material is applied to the surface (e.g., manhole) to be repaired. As the equivalent ratio of the reactants approaches about 1 to 1, solid quasi-prepolymers may result; such solid quasi-prepolymers would not be useful in the practice of this invention and should, therefore, be avoided. Two general methods have been found useful in the preparation of the quasi-prepolymers. In the first, the reactants are simply :mixed together and reacted at a temperature from about room temperature to 140° F. for a time sufficient to prepare the desired quasi-prepolymer. The time required will, of course, depend on the reaction temperature; generally an overnight reaction time will be sufficient. This first method is especially adapted for use in the present invention in that the reactants can simply be combined in a suitable container (e.g., a 55 gallon drum), heated if necessary, and the quasi-prepolymer will be ready to use the next morning. The quasi-prepolymers can also be prepared in a more controlled manner by adding the polyether polyol or the polyether amine slowly to the diisocyanate at the reaction temperature (room temperature to about 140° F.) so as to insure a large excess of the diisocyanate during the reaction. Using either method, solvent is not required. In some cases, cooling of the reactants may be desirable in order to control the exotherm. Generally, such cooling is not needed at the lower reaction temperatures.

Isocyanate-terminated polymers suitable for use in the present invention are generally available commercially. Examples of such commercially available materials include isocyanates such as PAPI94 from Dow Chemical Company, MRS Series isocyanates from Miles Inc., Mondur ML from Miles, Inc.; uretonimine modified methylene diphenyl diisocyanates such as Mondur CD from Miles, Inc., Isonate 143L from Dow Chemical Company and LF-168 from ICI Polyurethanes; quasi-prepolymers prepared from methylene diphenyl diisocyanates such as Mondur PF from Miles, Inc., Isonate 181 from Dow Chemical Company, and LF-179 from ICI Americas, Inc.. Other commercially available isocyanate-terminated polymers may also be used. Examples of polyether polyols useful in preparing quasi-prepolymers of the present invention include PolyG 20-56, PolyG 30-28, PolyG 85-36, PolyG 85-29, PolyG 76-120, PolyG 55-28, and PolyG 55-56 from Olin Corporation. Especially preferred polyether polyols are the polypropylene oxide polyetherdiols and ethylene oxide-capped polyether triols. Similar polyether polyols from other suppliers may also be used to prepare the quasi-prepolymers.

As noted above, the elastomeric material of the present invention is prepared by mixing and reacting an isocyanate-terminated compound with an amine compound containing at least two reactive amine groups wherein the mixing and reacting occurs immediately before the application to the surface to be repaired. The amine compound can be aliphatic or aromatic. The reactive amine can be a primary or a secondary amine. The amine-terminated compounds suitable for use in this invention generally have a mean functionality of about 2.0 to 3.0 and an average molecular weight of about 150 to 6000. Preferred amine compounds include amine-terminated polymers and aliphatic or aromatic diamines. Preferred amine-terminated polymers are the polyoxyalkyleneamines having primary amino groups attached to the terminus of polyether backbones (i.e., polyether amines). Examples of preferred aliphatic amine-terminated polymers include polymers of general formula IV $$H_2N-CH_2\underset{\underset{R''}{|}}{CH}+OCH_2\underset{\underset{R''}{|}}{CH}\underset{x}{]}OCH_2\underset{\underset{R''}{|}}{CH}-NH_2$$

where each R″ is independently hydrogen or a methyl radical. Preferably, R″ is a methyl radical and the average value of x is in the range of about 2 to 105 which corresponds to an average molecular weight of about 230 to 6000. An example of such an aliphatic amine-terminated polymer is the Jeffamine D-2000 amine-terminated polypropylene glycol from Texaco Chemical Co. where in the above formula IV, R″ is a methyl group, x has an average value of about 33, and the molecular weight is about 2000.

Triamine polymers can also be used. Examples of preferred aliphatic triamine-terminated polymers include polymers of general formula V $$\begin{array}{l} CH_2+OCH_2CHR'')_a-NH_2 \\ | \\ CH+OCH_2CHR'')_b-NH_2 \\ | \\ CH_2+OCH_2CHR'')_c-NH_2 \end{array}$$

where R″ is hydrogen or a methyl radical. Preferably R″ is a methyl radical and a, b, and c are independently in the range of about 0 to about 100 and such that the average molecular weight is in the range of from about 260 to about 6000. Specific example of such triamine-terminated polymers include Jeffamine T-3000 (average molecular weigh of 3000 and containing about 50 moles of polypropylene oxide) and Jeffamine T-5000 (average molecular weight of about 5000 and containing about 85 moles of polypropylene oxide) from Texaco Chemical Company.

Examples of suitable aliphatic amines include bis(-para-aminocyclohexyl)methane and mixed polycycloaliphatic amines (both commercially available from Air Products and Chemicals, Inc.). Examples of suitable aromatic amines include 3,5-diethyltoluene-2,4-diamine, 3,5-diethyltoluene-2,6-diamine, and mixtures thereof (commercially available as Ethacure 100 from Ehyl Corporation); para-di(N-alkyl)amine benzene (commercially available as Unilink 4100 from UOP); and 4,4′-methylene diphenyl di(N-alkyl)amine (commercially available as Unilink 4200 from UOP), as well as Unilink 8100, and Unilink 8130 from UOP. Oligomeric diamines (i.e., polytetramethyleneoxide di-p-aminobenzoate) such as Polamine-650, Polamine-1000, and Polamine-2000 from Air Products and Chemicals, Inc. can also be used.

Of course, mixtures of suitable isocyanate-terminated compounds and mixtures of suitable amine-terminated compounds can be used and are often preferred. Generally equivalent amounts (i.e., 1 to 1 ratios based on the reactive isocyanate and amine contents) of the isocyanate material and the amine material are mixed directly in the spray gun and the resultant reacting mixture is applied to the manhole surfaces to be coated. Various additives can be included in the isocyanate reactants and/or the amine reactants. For example, organic or inorganic colorants can be added to either reactants. By using colored dyes or colorants, the effectiveness of the mixing in the spray gun and application on the manhole surfaces can be determined visually: an elastomeric material of uniform color will generally indicate acceptable mixing and proper operation of the spray equipment. Examples of suitable dyes or colorants include 57AB Black, X17AB Blue, X38 Orange, X52 Red, and X15 Yellow from Milliken Chemical. Other commercially available dyes or colorants can be used so long as they are compatible with the reactants and other components. It is preferred that the elastomeric material is colored white using $TiO_2$ pigment. This greatly enhances the inspection capability of the finished manhole for spray quality and long term durability. It is also preferred that the isocyanate-terminated compounds and mixtures of suitable amine-terminated compounds are chosen to enable effective use of the $TiO_2$ pigment. That is, the unpigmented elastomeric material should be extremely light in color once cured.

Other additives, including light stabilizers, UV absorbers, anti-oxidants, adhesion promoters, and other processing aids or enhancers, can also be employed. Generally it is preferred to incorporate such additional components into the amine reactants. Examples of suitable light stabilizers include hindered amines such as Tinuvin 765 (bis (1,2,2,6,6-pentamethyl-4-piperidinyl) sebacate) and Tinuvin 770 (bis (2,2,6,6-tetramenthyl-4-piperidyl) sebacate) from Ciba-Geigy. Examples of suitable UV light absorbers include Tinuvin 328 and Tinuvin 571 from Ciba-Geigy (both are substituted benzotraiazoles). Examples of suitable antioxidants and thermal stabilizers include Irganox 259 (hexamethylene bis (3,5-di-tert-butyl -4-hydroxyhydro cinnamate), Irganox 1010(tetrakis [methylene(3,5-di-tert-butyl-4-hydoxyhydro cinnamate)]methane), and Irganox 1330 (1,3,5-trimethyl-2,3,6-tris (3,5-di-tert-butyl-4-hydroxybenzyl) benzene) from Ciba-Geigy. Examples of adhesion promoters include titanates and zirconates such as NZ 37 (zirconium IV 2,2-(bis-2-propenolatomethyl) butanolato, tris (4-amino) benzoato-O), NZ 44 (neopentyl(diallyl)oxy tri(m-ethylenediamoino) ethyl zirconate) and LICA 97 (neopentyl (diallyl)oxy tri(m-amino)phenyl titante) from Kenrich Petrochemicals. Various organofunctional silanes (especially the amino-functional silanes) may also be effective adhesion promoters; for example A-1100 (gammaaminopropyltriethoxysilane) from OSi Specialties. Light stabilizers, if used, will normally be present at about 0.2 to 0.75 weight percent in the amine reactants. UV light absorbers, if used, will normally be present at about 0.2 to 0.75 weight percent in the amine reactants. Antioxidants or thermal stabilizers, If used, will normally be present at about 0.1 to 0.5 weight percent in the amine reactants. Adhesion promoters, if used, will normally be present at about 0.05 to 0.2 weight percent in the amine reactants. Other conventional light stabilizers, UV light absorbers, antioxidants, thermal stabilizers, and adhesive promoters can also be used in place of, or in addition to, the specific examples given.

The following examples are intended to further illustrate the invention and not to limit the invention. Unless specified otherwise, all percentages in the following examples are by weight.

EXAMPLE 1

A ten-foot deep and three-foot diameter brick manhole in Michigan was used to demonstrate the effectiveness of this invention. This manhole was in relatively good condition with no missing bricks and relatively little missing mortor. The ambient temperature was about 65° F., the air being fairly damp as it had just rained. On the day prior to spraying, the manhole was first cleaned with high-pressure water to remove loose debris from the walls, bench, corbel, chimney, and metal frame. The frame was then sand-blasted to remove rust and provide a better bonding surface. A primer (Z7664 from Foamseal, Inc.) was then applied and allowed to dry. On the day of application the manhole was dried using forced hot air to remove surface moisture. It should be noted that the invert was not blocked and that water and sewage continued to flow through the manhole during the actual application of the elastomeric material. The isocyanate reactant consisted of a quasi-prepolymer prepared by reacting an isocyanate (Mondur ML from Miles, Inc.) with a dihydroxyl-terminated propylene oxide based polyether with a molecular weight of about 2000 (PolyG 20-56 from Olin Chemical). The isocyanate and polyether (50 to 50 weight ratio) were mixed together and allowed to react at 140° F. for about 16 hours. The amine reactant consisted of a polymeric aliphatic diamine (59.9% Jeffamine D-2000 from Texaco Chemical), an aromatic diamine (24.0%; Ethacure 100 from Ethyl Corporation), a polymeric aromatic diamine (7.0%; Polamine 650 from Air Products and Chemicals), a silane adhesion promoter (0.2%; A-1100 from OSi Specialties) and a Titanium Dioxide pigment (9.3%; 34-18000 White from Ferro Chemical, about 65% Titamiun Dioxide in a 56 OH# polyether triol vehicle). The spray elastomeric material was used to spot patch areas where the mortor was missing and then the manhole surface was given a flash coating of the elastomeric material to improve bonding. The temperature of the reactants was about 155° F. as sprayed. The entire interior surfaces of the manhole, including the brick and mortor surface, frame, ladder rungs, and a portion of the bench were coated with the elastomeric material to a thickness of about ⅛ inch, thereby forming a non-porous, homogeneous, monolithic liner. Rehabilitation took approximately 30 minutes. The elastomeric material was then inspected visually for thin areas. A couple of spots were resprayed to bring them up to the required thickness. After about ten minutes the elastomeric material was aggressively pounded with a hammer to evaluate its toughness and cure characteristics. No chipping or cracking was observed. Based on this evaluation it was shown that the manhole could be returned to service immediately.

EXAMPLE 2

A sprayable elastomeric material was prepared using the following reactants. The isocyanate reactant consisted of a quasi-prepolymer prepared by reacting an isocyanate (PAPI 94 from Dow Chemical) with a trihydroxyl-terminated ethylene oxide-capped polyether with a molecular weight of about 4500 (PolyG 85-36 from Olin Chemicals). The isocyanate and the polyether (67 to 33 weight ratio) were simply mixed together and allowed to react at 110° F. for about 24 hours. The amine reactant consisted of a polymeric aliphatic triamine (34.8%; Jeffamine T-3000 from Texaco), a polymeric aliphatic diamine (20.0%; Jeffamine D-2000 from Texaco), two aromatic diamines (25% of Ethacure 100 from Ethyl Corporation, and 20% of Unilink 4100 from UOP); and a titanate adhesion promoter (0.2%; Ken-React LICA 97 from Kenrich Petrochemicals). Combining the isocyanate reactant and the amine reactant in spray gun resulted in a fast-curing, elastomeric material suitable for use in repairing and rehabilitating manhole structures.

EXAMPLE 3

Another sprayable elastomeric material was prepared using the following reactants. The isocyanate reactant consisted of a quasi-prepolymer prepared by reacting a monomeric methylene diphenyl diisocyanate having a relatively high proportion of the 2,4'-isomer (Mondur ML from Miles, Inc.) with a trihydroxyl-terminated ethylene oxide-capped polyether with a molecular weight of about 4500 (PolyG 85-36 from Olin Chemicals). The isocyanate and the polyether (50 to 50 weight ratio) were simply mixed together and allowed to react at 110° F. for about 24 hours. The amine reactant consisted of a polymeric aliphatic diamine (64.9%; Jeffamine D-2000 from Texaco), two aromatic diamines (20% of Ethacure 100 from Ethyl Corporation and 15% of Unilink 4200 from UOP); and a titanate adhesion promoter (0.1%; Ken-React LICA 97 from Kenrich Petrochemicals). Combining the isocyanate reactant and the amine reactant in spray gun resulted in a fast-curing, elastomeric material suitable for use in repairing and rehabilitating manhole structures. The elastomeric material produced from this example is expected to have better low temperature performance (i.e., thermal cycling) than the material described in Example 2.

EXAMPLE 4

This invention was used in a pre-production trial of 250 manholes in Illinois. This trial was to demonstrate the effectiveness of the invention under actual field conditions over an extended period of time. In general the condition of the manholes was fair to poor. The weather ranged from cold and wet to warm and dry. After repairing major structural damage with conventional grouting techniques, a 5% Z-6020 silane (Dow Corning) aqueous primer solution was applied to the manhole surface and dried using forced hot air. The elastomeric material, consisting of the isocyanate and amine components described in Example 1, was then applied to the manhole walls using described technique. As the job progressed any flaws were corrected by cutting out said sections, repriming and respraying. It was found that the material adheres well to itself and the repaired sections were as strong as the surrounding material. It was found that the invention processed well, was able to cover at least four manholes a day when being applied by a single crew, and effectively eliminated water infiltration into the repaired manholes.

EXAMPLE 5

To test the effectiveness of a silane primer at higher concentrations, a 20% aqueous solution of an organosilane [aminoethyl aminopropyl trimethoxysilane] was prepared and applied to a concrete brick and allowed to dry. An elastomeric material as described in example #1 was then sprayed onto the brick and allowed to cure. As a control the same elastomeric material was applied to a concrete brick that had not been primed. Tensile adhesion was tested using a jig similar to that described in ASTM specification D 1623-78 Type B. A metal block was bonded to the elastomer using a high performance epoxy adhesive. The bonding area was 1 inch by 1 inch (1 $in^2$). After the epoxy had cured the elastomer was scored so that only the material bonded to the block would affect the results. The brick/elastomer/metal block assembly was then mounted in a tensile tester. A grip with a universal joint was then attached to the metal block, this grip also being attached to the load cell of the tester. The tensile tester then pulled the assembly away from the load cell until tensile failure occurred. It was found that the adhesive bond to the unprimed block failed at about 230 psi whereas the adhesive bond to the block primed with a 20% aqueous solution of the organosilanne failed at about 510 psi, an increase of over 120%. The unprimed sample clearly showed adhesive failure of the elastomer to the concrete brick. The primed sample showed a majority of failure in the brick itself. That is, there was cohesive failure of the brick before adhesive failure of the bond.

That which is claimed is:

1. A method for lining or relining an existing engineering structure to rehabilitate, reinforce, and protect the engineering structure, said method comprising:

a. preparing the surface of the engineering structure to be lined or relined by cleaning the brick, tile, concrete block, concrete, mortar, or foreign material from the surface;

b. spraying a liquid primer on the surface of the engineering structure, said primer adapted to promote adhesion of an elastomeric material to said engineering structure;

c. applying a polyurea elastomeric material to the prepared surface of the engineering structure to be lined or relined by spraying the elastomeric material onto the prepared surface whereby a monolithic, continuous polyurea elastomeric coating is formed on the prepared surface, wherein the fast-curing polyurea elastomeric material is prepared by rapidly mixing and initiating the reaction of an isocyanate-terminated compound having reactive isocyanate groups with an amine-terminated compound having reactive amine groups immediately before spraying the elastomeric material onto the prepared surface; and d. allowing the fast-curing polyurea elastomeric coating to cure, whereby an elastomeric polyurea liner is formed on the prepared surface to rehabilitate, reinforce, and protect the engineering structure.

2. The method as defined in claim 1, wherein said method includes spraying an aqueous solution of a silane primer.

3. The method as defined in claim 2, wherein said method includes spraying an aqueous solution of said silane primer having at least 5% of aminoethyl aminopropyl trimethoxysilane.

4. A method for lining or relining the interior surface of a manhole to rehabilitate, reinforce and protect the structure of said manhole, said method comprising:

a. preparing said interior surface of said manhole to be lined or relined by cleaning the brick, tile, concrete block, concrete, mortar, or metal forming said interior surface and removing loose particles of brick, tile, concrete block, concrete, mortar, or foreign material from said surface;

b. spraying a liquid primer on said interior manhole surface, said primer promoting adhesion of a polyurea elastomeric material which is the reaction product of an isocyanate-terminated compound and an amine-terminated compound;

c. applying a polyurea elastomeric material to said prepared interior manhole surface to be lined or relined by spraying a fast-curing polyurea elastomeric material onto said prepared surface, whereby a monolithic, continuous polyurea elastomeric coating is formed on said prepared surface, wherein said fast-curing polyurea elastomeric materials is prepared by rapidly mixing and initiating the reaction of an isocyanate-terminated compound and an amine-terminated compound immediately before spraying the fast-curing polyurea material onto said prepared surface; and d. allowing said fast-curing polyurea elastomeric coating to cure, whereby an elastomeric polyurea liner is formed on said prepared surface to rehabilitate, reinforce and protect said manhole interior surface.

5. The method as defined in claim 4, wherein said method includes spraying an aqueous solution of silane primer on said manhole interior surface and allowing said primer to dry before applying said polyurean elastomeric material.

6. The method as defined in claim 5, wherein said method includes spraying an aqueous solution of said silane primer on said manhole interior surface having at least 10% of an aminoethyl aminopropyl trimethyloxysilane.

7. A method as defined in claim 4, wherein said isocyanate-terminated compound is a monomeric or polymeric methylene diphenyl diisocyanate or a mixture of monomeric or polymeric methylene diphenyl diisocyanates of the general formula

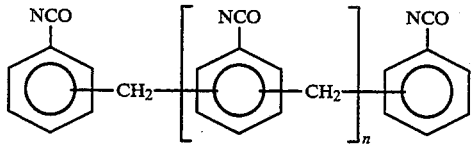

where n is an integer from 0 to about 10 and wherein said method includes rapidly mixing said isocyanate-terminated compound with amine-terminated compound, then spraying said interior surface of said manhole with said polyurea elastomeric material.

8. A method as defined in claim 4, wherein the isocyanate-terminated compound is a quasi-prepolymer or mixture of quasi-prepolymers of general formula

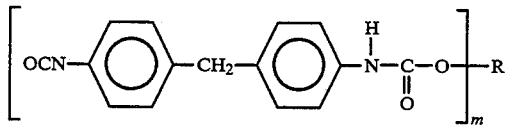

or of general formula

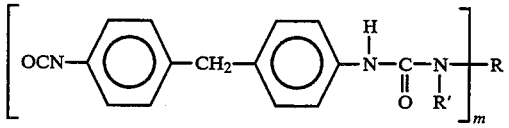

where m is equal to 2 or 3, R′ is a hydrogen or an aliphatic radical, and R is an aliphatic polyether, said method including rapidly mixing said isocyanate-terminated compound with said amine-terminated compound, then immediately spraying said manhole interior surface with said polyurea elastomeric material.

9. The method as defined in claim 4, wherein the method includes spraying a primer on said repaired manhole interior surface containing 10% to 30% silane.

* * * * *

Disclaimer 5,415,499—Peter K. Hyde-Smith, Mayville; Yeara Houvras, West Bloomfield, both of Mich. METHOD FOR THE REPAIR OF EXISITING MANHOLES USING ELASTOMERIC MATERIALS. Patent dated May 16, 1995. Disclaimer filed January 7, 2002 by the assignee, Illinois Tool Works Inc.

Hereby disclaims and dedicates to the Public claims 1-3 of said patent.

*(Official Gazette, August 27, 2002)*